US006426614B1

(12) United States Patent
Guthrie

(10) Patent No.: US 6,426,614 B1
(45) Date of Patent: Jul. 30, 2002

(54) BOOT-STRAPPED CURRENT SWITCH

(75) Inventor: Martin G. Guthrie, Mississauga (CA)

(73) Assignee: Research In Motion Limited, Waterloo (CA)

( * ) Notice: Subject to any disclaimer, the term of this patent is extended or adjusted under 35 U.S.C. 154(b) by 0 days.

(21) Appl. No.: 09/934,895

(22) Filed: Aug. 22, 2001

Related U.S. Application Data

(60) Provisional application No. 60/227,523, filed on Aug. 24, 2000.

(51) Int. Cl.[7] ..... G05F 1/40
(52) U.S. Cl. ..... 323/315; 327/535
(58) Field of Search ..... 323/312, 313, 323/315; 327/535, 537, 538, 543

(56) References Cited

U.S. PATENT DOCUMENTS 5,083,079 A * 1/1992 Plants ..... 323/313
5,418,674 A * 5/1995 Davies et al. ..... 361/18
5,422,563 A * 6/1995 Pflueger ..... 323/312

* cited by examiner

*Primary Examiner*—Matthew Nguyen
(74) *Attorney, Agent, or Firm*—Jones, Day, Reavis & Pogue; Krishna K. Pathiyal, Esq.; Charles B. Meyer, Esq.

(57) ABSTRACT

A boot-strapped current switch is provided that includes a biasing network, a control signal, a transistor, a control switch and a boot-strapping circuit. The biasing network generates a substantially constant voltage on a biasing network output. The transistor has a control terminal, a first current-carrying terminal, and a second current-carrying terminal, wherein the first current-carrying terminal generates the output current of the current mirror, and the second current-carrying terminal is coupled to a first potential. The control switch is coupled between the biasing network output and the control terminal of the transistor, and is also coupled to the control signal. The control switch couples the first biasing network output to the control terminal of the transistor when the control signal is in a first state. The boot-strapping circuit is coupled between the control terminal of the transistor and a second potential, and is also coupled to the control signal. The first boot-strapping circuit injects the second potential onto the control terminal of the transistor when the control signal transitions from a second state to the first state in order to decrease the turn-on time of the transistor.

53 Claims, 11 Drawing Sheets

BOOT-STRAPPED CURRENT SWITCH

CROSS-REFERENCE TO RELATED APPLICATION

This application claims priority from and is related to the following prior application: A Boot-Strapped Current Switch And Switching Method, U.S. Provisional Application No. 60/227,523, filed Aug. 24, 2000. This prior application, including the entire written description and drawing figures, is hereby incorporated into the present application by reference.

BACKGROUND

1. Field of the Invention

This invention generally relates to current switches. More particularly, the invention provides a boot-strapped current switch that is particularly well suited for use as a current switching element in a current mirror circuit.

2. Description of the Related Art

FIG. 1 is a circuit diagram of a typical current mirror 10. The current mirror 10 is a common circuit in which current flowing in one portion of the circuit is mirrored in another portion of the circuit. The current mirror 10 comprises a current source 12, and two metal-oxide semiconductor field-effect transistor (MOSFETs) 14 and 16. The current source 12 supplies a reference current (Iref) to one of the MOSFETs 14 which is mirrored in the second MOSFET 16 because the gate-source voltages of both MOSFETs 14 and 16 are substantially similar.

In many applications the current mirror 10 shown in FIG. 1 is modified to create a switched current mirror. Switched current mirrors are used, for example, in charge pumps and digital to analog converters (DACs). Examples of switched current mirrors typically used in a charge pump circuit are described below with reference to FIGS. 3–7.

FIG. 2 is a simplified diagram of a typical charge pump circuit 20. As shown in FIG. 2, a charge pump is conceptually equivalent to two switched current sources 22 and 24, where one current source 22 is biased to power and the other current source 24 is biased to ground. When the charge pump 20 receives a signal (UP) at switch 23 to connect the power-side current source 22, a positive current is generated at the charge pump output 26. Similarly, when the charge pump 20 receives a signal (DN) at switch 25, turning on the ground-side current source 24, a negative current is generated at the output 26.

FIGS. 3–5 show known charge pump designs wherein the current direction of the charge pump output (Iout) is controlled by opening and closing switches (UP and DN) connected to either the drain, source or gate of one of the MOSFETs in each current mirror. FIG. 3 is a circuit diagram of a known charge pump circuit 30 implemented with switched-drain current mirrors 32 and 34. The switched-drain charge pump 30 includes the two current mirrors 32 and 34, two current sources 33 and 35 and two switches (UP and DN) 36 and 38. The switches 36 and 38 are coupled to the drain terminals of one of the MOSFETSs in each current mirror 32 and 34 such that when the UP switch 36 is closed the charge pump 30 generates a positive output current (Iout), and when the DN switch 38 is closed the charge pump 30 generates a negative output current (Iout).

FIG. 4 is a circuit diagram of a known charge pump circuit 40 implemented with switched-source current mirrors 42 and 44. The switched-source charge pump 40 includes the two current mirrors 42 and 44, two current sources 43 and 45, and two switches (UP and DN). This switched-source charge pump 40 operates similarly to the switched-drain charge pump 30 shown in FIG. 3, except the switches (UP and DN) 46 and 48 are coupled to the source terminals of the respective current mirror MOSFETs. In both the switched-source charge pump 40 and the switched-drain charge pump 30, the UP and DN switches 36, 38, 46 and 48 are connected in the current path of the charge pump output (Iout), resulting in glitch currents when the switches are opened or closed. These glitch currents are typically caused by clock-feedthrough of the UP and DN control signal. Clock-feedthrough results when a control voltage on the gate of a MOSFET switch couples through to the drain terminal and/or source terminal via parasitic capacitances. Moreover, control switches 36, 38, 46 and 48 that are placed in the output current path typically require low resistances, thus large devices are usually employed; resulting in higher parasitic capacitances and consequent clock-feedthrough.

FIG. 5 is a circuit diagram of a known charge pump circuit 50 implemented with switched-gate current mirrors 52 and 54. The switched-gate charge pump 50 includes two current mirrors 52 and 54, two current sources 53 and 55, and two switches (UP and DN) 56 and 58. The switches 56 and 58 are respectively coupled to the FET gate terminals of the current mirrors 52 and 54. Operationally, the charge pump 50 generates a positive output current (Iout) when the UP switch 56 is opened, and a negative output current (Iout) when the DN switch 58 is opened. This charge pump circuit 50 reduces current glitches by removing the control switches (UP and DN) 56 and 58 from the output current path, but typically exhibits a relatively slow switching speed.

FIGS. 6(*a*)–6(*d*) show some typical switching circuits that may be used to implement the UP and DN switches 36, 38, 46, 48, 56 and 58 shown in FIGS. 3–5. All of the UP and DN switches 36, 38, 46, 48, 56 and 58 may be implemented, for example, as a singal n-type FET as shown in FIG. 6(*a*), as a singal p-type FET as shown in FIG. 6(*b*), or as a combination of FETs as shown in FIGS. 6(*c*) and 6(*d*). In FIG. 6, and in subsequent drawing figures throughout this application, true and inverted versions of the same signal are designated using an overbar convention. For instance, in FIGS. 6(*b*), 6(*c*) and 6(*d*), $\overline{\text{DN}}$ is an inverted version of the DN signal.

FIG. 7 is a circuit diagram of a known current steering charge pump circuit 70. The charge pump circuit 70 includes two p-channel MOSFET transistors (PMOS) 72 and 74, two n-channel MOSFET transistors (NMOS) 76 and 78 and two current sources 80 and 82. Operationally, the charge pump 70 generates either a positive or negative output current (Iout) by switching between the two current sources 80 and 82. When the UP signal is low, the positive current source 80 is switched to the charge pump output (Iout) by the PMOS transistor 74, and the PMOS transistor 72 is off. Then, when the UP signal is high, the $\overline{\text{UP}}$ signal is low and the current from source 80 is switched to ground by the PMOS transistor 72. In this manner, the current (Ip) from current source 80 is "steered" between the charge pump output (Iout) and ground. In this example, ground is the "dummy load," however voltages other than ground are also commonly used. Similarly, when the DN signal is high, the negative current source 82 is switched to the charge pump output (Iout) by NMOS 78. A high DN signal, and consequent low $\overline{\text{DN}}$ signal, steers the current (Ip) from source 82 through NMOS 76. One skilled in the art will appreciate that current steering improves the speed of the charge pump because the current mirror is always on, supplying current to either the output load or the dummy load. This always-on condition, however, is often undesirable in power sensitive applications such as wireless communication devices. In addition, the PMOS transistor 74 and the NMOS transistor 78 are in series with the charge pump output current, and may consequently add glitch currents to the output due to clock-feedthrough.

SUMMARY

A boot-strapped current switch is provided that includes a biasing network, a control signal, a transistor, a control switch and a boot-strapping circuit. The biasing network generates a substantially constant voltage on a biasing network output. The transistor has a control terminal, a first current-carrying terminal, and a second current-carrying terminal, wherein the first current-carrying terminal generates the output current of the current mirror, and the second current-carrying terminal is coupled to a first potential. The control switch is coupled between the biasing network output and the control terminal of the transistor, and is also coupled to the control signal. The control switch couples the first biasing network output to the control terminal of the transistor when the control signal is in a first state. The boot-strapping circuit is coupled between the control terminal of the transistor and a second potential, and is also coupled to the control signal. The first boot-strapping circuit injects the second potential onto the control terminal of the transistor when the control signal transitions from a second state to the first state in order to decrease the turn-on time of the transistor.

DETAILED DESCRIPTION

Figure 8:
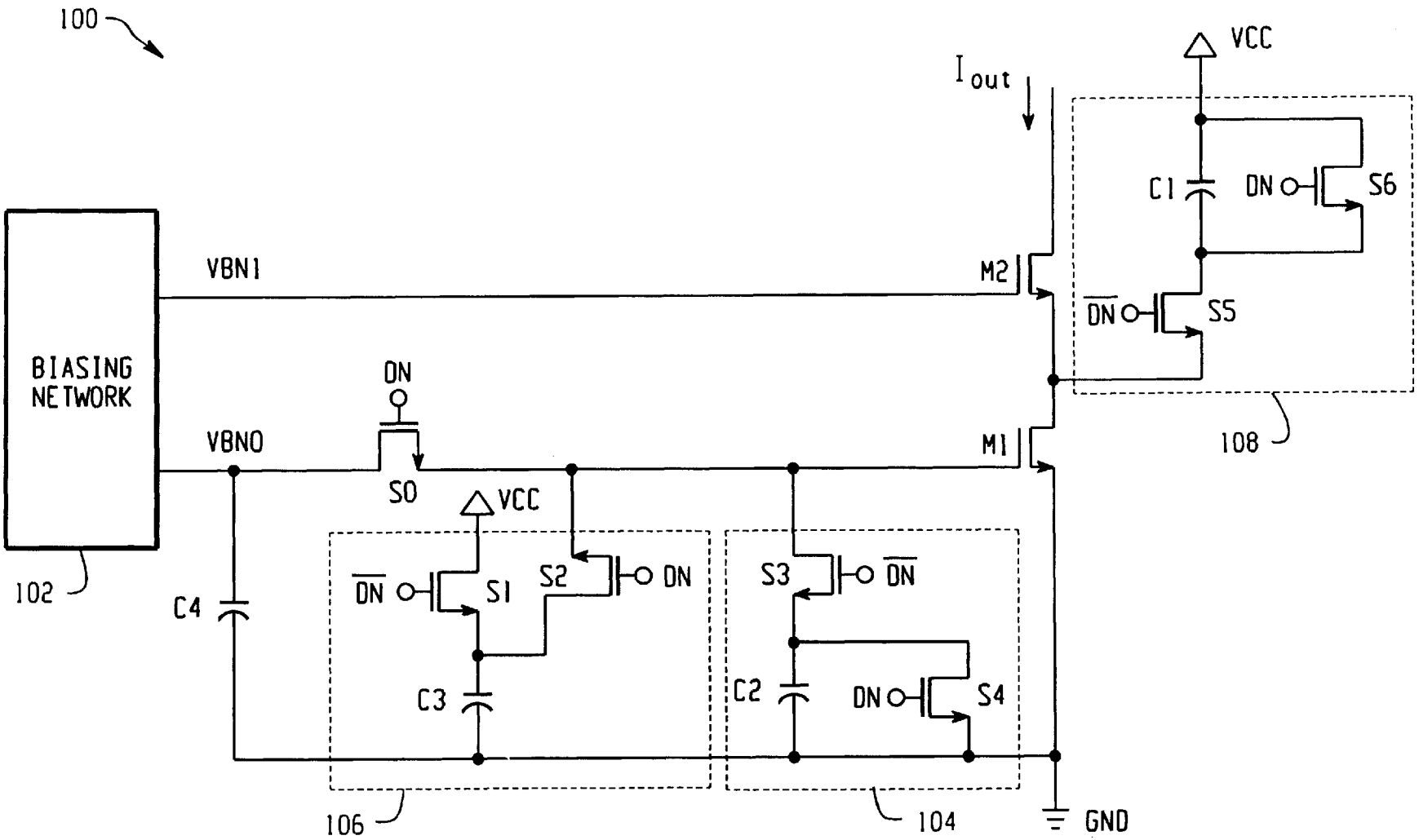
FIG. 8 is circuit diagram of an exemplary boot-strapped current mirror that generates a negative output current (Iout)

Referring now to the remaining drawing figures, FIG. 8 is circuit diagram of an exemplary boot-strapped current mirror 100 that generates a negative output current (Iout). This circuit 100 includes a biasing network 102, two NMOS devices M1 and M2, an NMOS control switch S0, a filtering capacitor C4, and three boot-strapping circuits 104, 106, and 108. One of the boot-strapping circuit 104 includes a capacitor C2 and two NMOS switches S3 and S4, and is coupled to the gate terminal of the NMOS device M1. Another boot-strapping circuit 106 includes a capacitor C3 and two NMOS switches S1 and S2, and is also coupled to the gate terminal of the NMOS device M1. Yet another boot-strapping circuit 108 includes a capacitor C1 and two NMOS switches S5 and S6, and is coupled to the source terminal of the NMOS device M2. In addition, each of the NMOS switches S0–S6 is coupled to either a true or inverted control signal DN or $\overline{DN}$. The DN control signal is preferably generated by an external circuit, and the inverted control signal, $\overline{DN}$, is preferably either similarly generated by an external circuit or by inverting DN.

The biasing network 102, described below with reference to FIGS. 10(*a*)–10(*c*), generates two substantially constant voltage outputs, VBN0 and VBN1, that are respectively coupled to the gate terminals of the two NMOS devices M1 and M2, with the first output VBN0 being coupled through the NMOS control switch S0. The source terminal of the NMOS devices M2 is coupled to the drain terminal of the other NMOS device M1, and the source terminal of M1 is coupled to ground. The drain terminal of the NMOS device M2 may be coupled to a load to implement a single current mirror. Alternatively, the drain terminal of M2 may be coupled to the output of a second current mirror to implement a current mirror pair, such as the charge pump described below with reference to FIG. 15. In addition, the filtering capacitor C4 is preferably coupled between the first biasing network output VBN0 and ground to minimize noise in the current mirror output (Iout), and to provide in-rush current to the gate of M1 as the NMOS control switch S0 is closed. In an alternative embodiment, noise may be further reduced in the output current (Iout) by coupling a resistor between the source terminal of M1 and ground, and coupling a corresponding resistor in the biasing network 102. Operationally, when the control signal DN is in high state, the control switch S0 is closed and the NMOS devices M1 and M2 are ON, generating a negative current mirror output (Iout) at the source terminal of M1.

The boot-strapping circuits 104, 106 and 108 improve the turn-on and/or turn-off speeds of the current mirror 100 by injecting a potential onto critical nodes of the circuit 100 as the circuit 100 transitions between its ON and OFF states. In the boot-strapping circuit 104, the capacitor C2 is coupled between ground and the gate terminal of M1 through the NMOS switch S3, and the NMOS switch S4 is coupled in parallel with the capacitor C2. This boot-strapping circuit 104 improves the turn-off speed of the circuit 100 by injecting a zero potential (ground) at C2 onto the gate terminal of M1 as the current mirror 100 is turned OFF, and also improves the turn-on speed by reducing the voltage swing necessary to reach the threshold turn-on voltage of M1. In the boot-strapping circuit 106, the capacitor C3 is coupled between the power supply voltage VCC and ground through the NMOS switch S1, and is also coupled to the gate terminal of M1 through the NMOS switch S2. This circuit 106 improves the turn-on speed of the current mirror 100 by injecting the power supply voltage VCC at C3 onto the gate terminal of M1 as the current mirror 100 is turned ON. In the boot-strapping circuit 108, the capacitor C1 is coupled between the power supply voltage VCC and the source terminal of M2 through the NMOS switch S5, and the NMOS switch S6 is coupled in parallel with the capacitor C1. This boot-strapping circuit further improves the turn-off speed of the current mirror 100 by injecting the power supply voltage VCC at C1 onto the source terminal of M2 as the current mirror is turned OFF.

In alternative embodiments, the current mirror 100 could be implemented with less than all of the three boot-strapping circuits 104, 106 and 108. For instance, the turn-on speed of the current mirror 100 could be improved by including only the boot-strapping circuit 104 or 106. Similarly, the turn-off speed of the current mirror 100 could be improved by including only the boot-strapping circuit 104 or 108.

Operationally, when the DN control signal is in a high state, the current mirror 100 is ON. During the ON state of the circuit 100, the NMOS control switch S0 is closed, and the constant voltage outputs VBN0 and VBN1 from the biasing network 102 are applied to the gates of the NMOS devices M1 and M2, controlling the output current (Iout) flow through M1 and M2. In addition, while the current mirror 100 is ON, the capacitor C2 is discharged through the NMOS switch S4, and the capacitor C1 is charged to the power supply voltage VCC through the NMOS switch S6.

The output current (Iout) is switched OFF when the control signal DN undergoes a transition from high to low. The high to low transition of DN causes the NMOS control switch S0 to open, disconnecting the gate of M1 from the biasing network 102. In addition, the high to low transition of DN causes the NMOS switch S3 to close, connecting the gate of M1 to the capacitor C2, which was discharged during the preceding ON state of the circuit 100. Therefore, when the gate of M1 is connected to the capacitor C2, the ratio of the capacitance of C2 and the parasitic gate-source capacitance of M1 is such that the gate voltage of M1 is quickly reduced to a level below the threshold voltage of M1, causing current flow through M1 to stop. In an alternative embodiment, the NMOS switch S3 may connect the gate of M1 directly to ground as the circuit 100 is turned OFF. Including the capacitor C2 in the circuit 100, however, decreases the voltage swing necessary to turn M1 back on, and consequently improves the turn-on speed of the current mirror 100.

With respect to the NMOS device M2, as the circuit 100 is turned OFF, the NMOS switch S5 is closed and the NMOS switch S6 is opened, connecting the source terminal of M2 to the capacitor C1, which was charged to the power supply voltage VCC during the preceding ON state. By injecting the power supply voltage VCC at C1 onto the source terminal of M2, the source voltage at M2 is increased in proportion to the ratio of the capacitance of C1 and the parasitic capacitances of M1 and M2. In this manner, the source terminal voltage of M2 is rapidly increased, making the gate-source voltage of M2 less than its threshold turn-on voltage.

While the current mirror 100 is OFF, the capacitor C3 is charged to the power supply voltage VCC through the NMOS switch S1. Then, when DN changes from low to high and the circuit 100 is switched back ON, the NMOS control switch S0 and the NMOS switch S2 close and the voltage at the capacitor C3 is injected onto the gate of M1 along with the output of the biasing network VBN0. Although the biasing current at VBN0 is typically small, the voltage at C3 quickly increases the gate voltage of M1 in proportion to the ratio of the capacitance of C3 and the parasitic capacitance of M1. The value of the capacitor C3, therefore, affects the response of the output current (Iout) as the current mirror switch 100 is turned ON. Increasing the value of the capacitor C3 consequently decreases the turn-on time of M1, but may also result in some overshoot in the output current (Iout). The value of C3 should, therefore, preferably be chosen to minimize the switching time while limiting overshoot to an acceptable level. In addition to the voltage injected by the capacitor C3, further voltage may be added to the gate of M1 by the filtering capacitor C4 which is preferably a large capacitor.

With respect to the NMOS device M2, as the current mirror 100 is turned ON, the NMOS switch S5 is opened, disconnecting the capacitor C1 from the source of M2. Then, the drain of M1 and the source of M2 are quickly discharged as M1 turns on. As the source of M2 is discharged, its gate-source voltage rises above the threshold voltage, and M2 is turned on.

Figure 1:
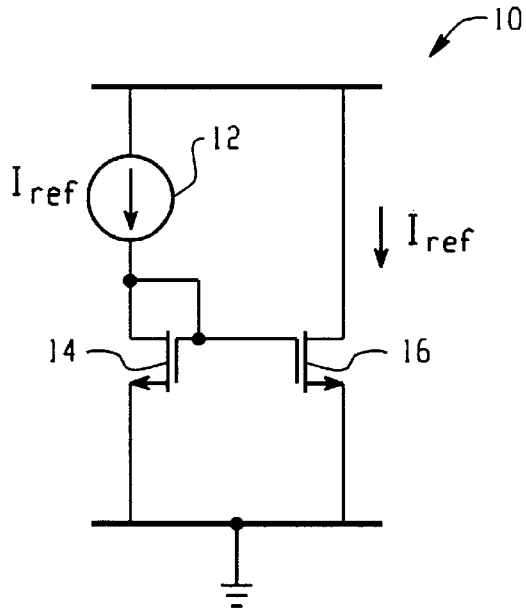
Fig. 1 RELATED ART
FIG. 1 is a circuit diagram of a typical current mirror.
Figure 2:
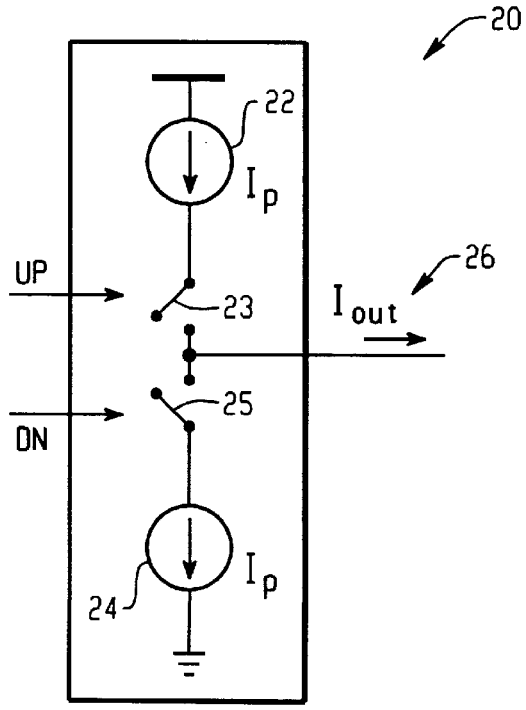
Fig. 2 RELATED ART
FIG. 2 is a simplified diagram of a typical charge pump circuit.
Figure 3:
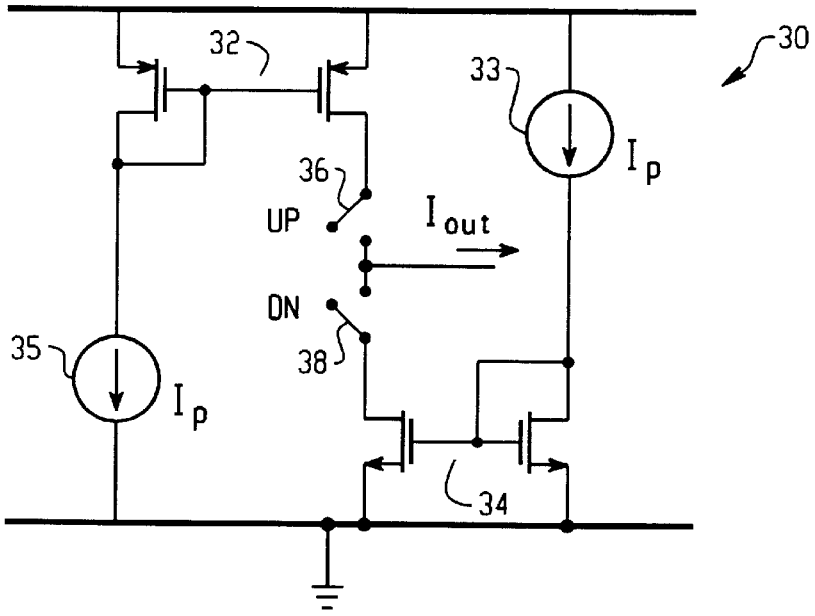
Fig. 3 RELATED ART
FIG. 3 is a circuit diagram of a known charge pump circuit implemented with switched-drain current mirrors.
Figure 4:
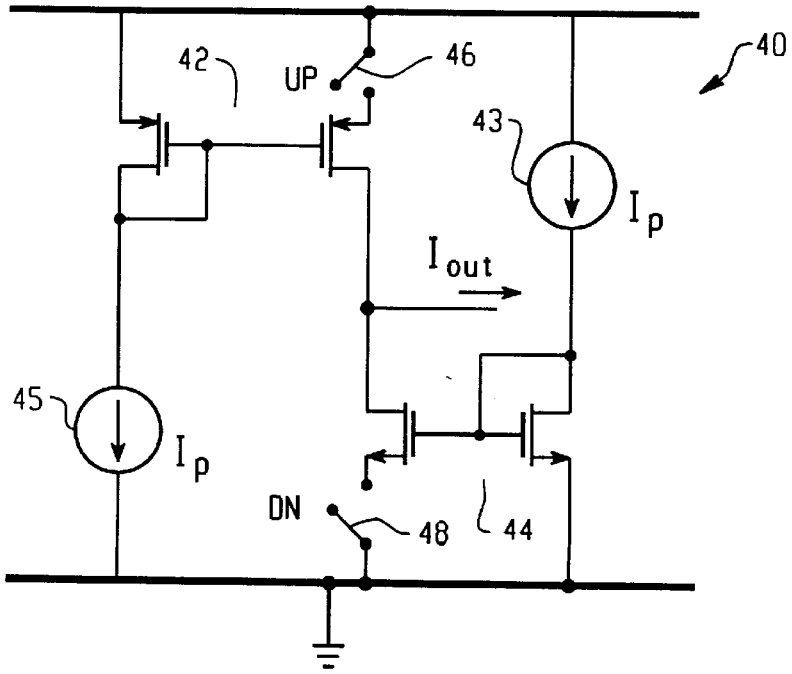
Fig. 4 RELATED ART
FIG. 4 is a circuit diagram of a known charge pump circuit implemented with switched-source current mirrors.
Figure 5:
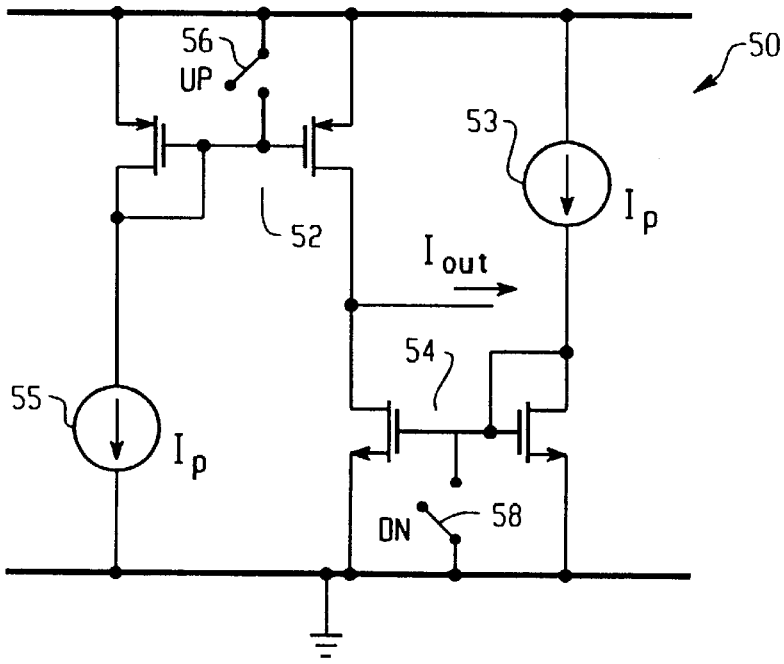
Fig. 5 RELATED ART
FIG. 5 is a circuit diagram of a known charge pump circuit implemented with switched-gate current mirrors.
Figure 6A:
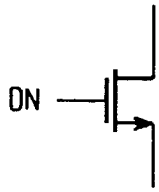
Fig. 6(a) RELATED ART
FIGS. 6(*a*)–6(*d*) show some typical switching circuits that may be used to implement the UP and DN switches shown in FIGS. 3–5.
Figure 6B:
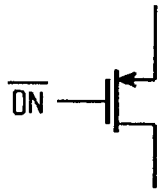
Fig. 6(b) RELATED ART
Figure 6C:
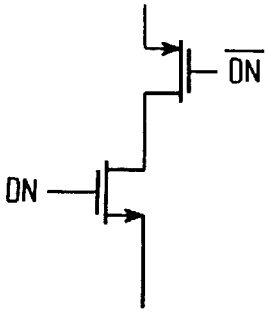
Fig. 6(c) RELATED ART
Figure 6D:
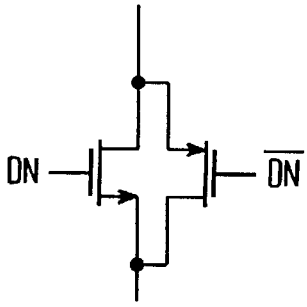
Fig. 6(d) RELATED ART
Figure 7:
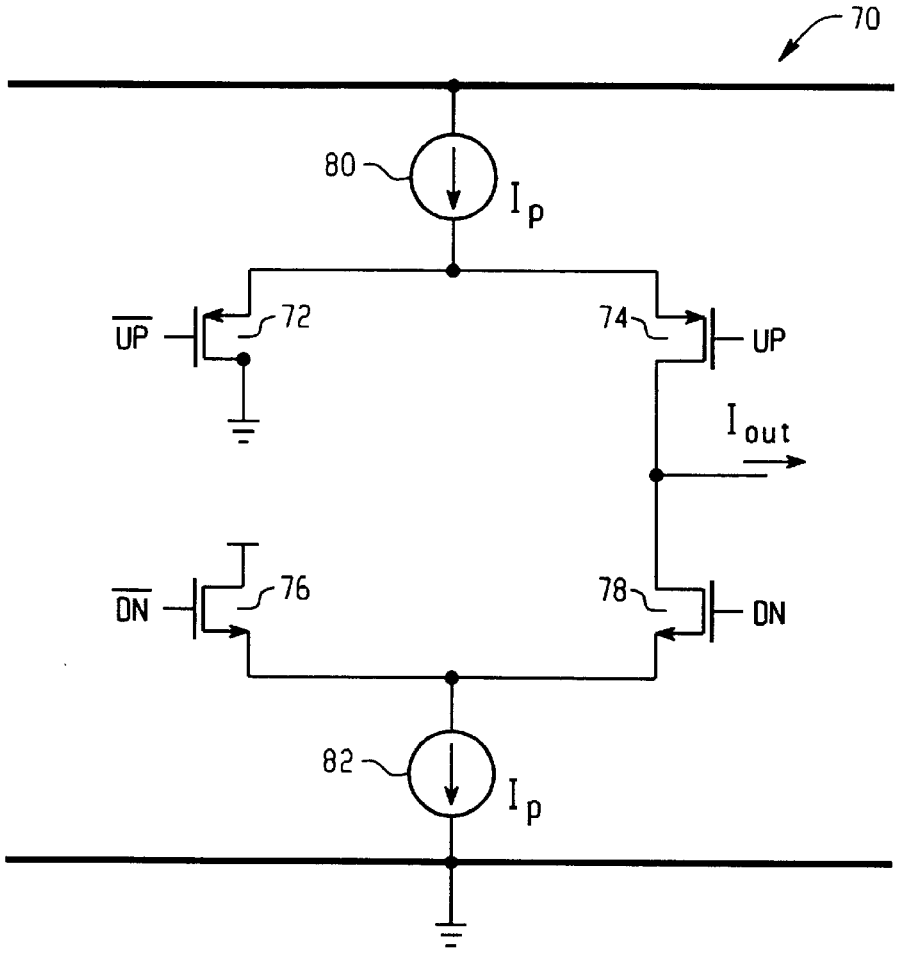
Fig. 7 RELATED ART
FIG. 7 is a circuit diagram of a known current steering charge pump circuit.
Figure 9A:
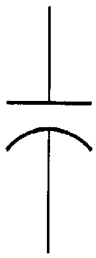
FIGS. 9(*a*)–9(*c*) are three exemplary embodiments of the capacitors C1–C4 shown in FIG. 8.
Figure 9B:
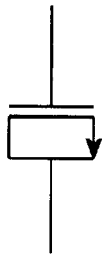
Figure 9C:
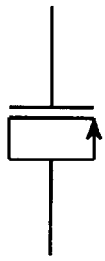

This exemplary boot-strapped current mirror 100 could be implemented, for example, as the DN switch 25 and the negative current source 24 in the charge pump 20 of FIG. 2. It should be understood, however, that the current mirror 100 is not restricted to use in a charge pump. For example, in other applications, the DN and $\overline{DN}$ signals that are coupled to the switches S0–S6 could be opposite polarities of an appropriate control signal. It should also be understood, that although the switches S0–S6 are shown as NMOS devices, the current mirror 100 may be implemented with other known switch types or designs, such as those shown in FIGS. 6(*b*)–6(*d*). For instance, by substituting PMOS switches as shown in FIG. 6(*b*) for the NMOS switches S0–S6 and reversing VCC and ground, the current mirror 100 could be implemented as the UP switch 23 and positive current source 22 in the charge pump 20 shown in FIG. 2. In addition, the capacitors C1–C4 may be implemented with either conventional capacitors, as shown in FIG. 9(*a*), or with other known active or parasitic capacitors, such as those shown in FIGS. 9(*b*) and 9(*c*).

Figure 10C:
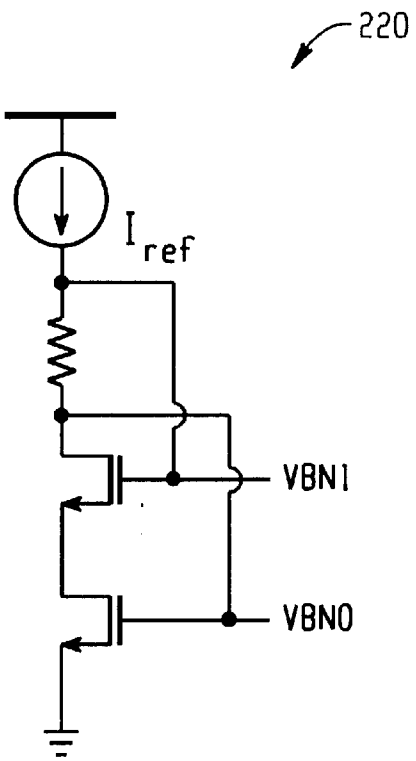
FIGS. 10(*a*)–10(*c*) are circuit diagrams of three typical biasing networks which could be implemented as the biasing network shown in FIG. 8.
Figure 10B:
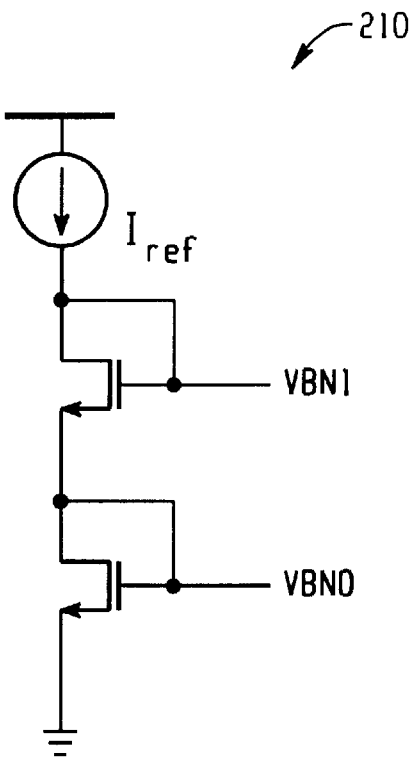
Figure 10A:
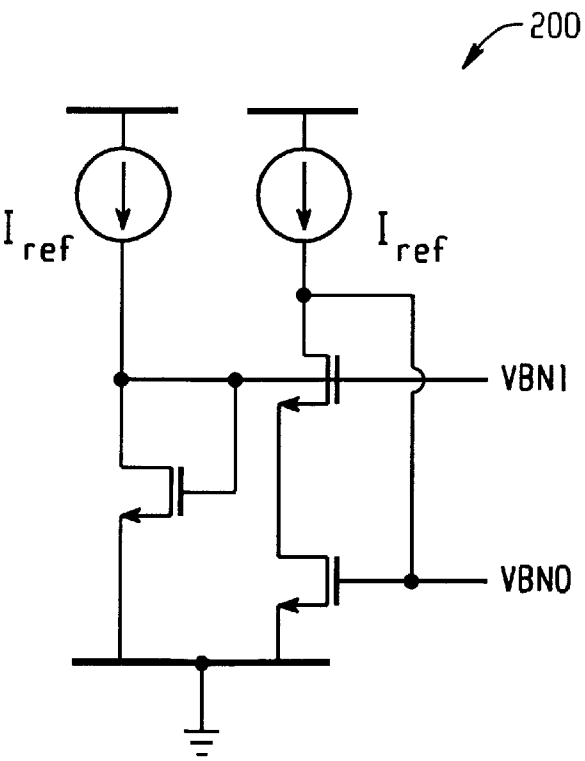

FIGS. 10(*a*)–10(*c*) are circuit diagrams of three typical biasing networks which could be implemented as the biasing network 102 shown in FIG. 8. The biasing circuit 200 shown in FIG. 10(*a*) forms a wide-swing current mirror with the NMOS devices M1 and M2 of FIG. 8, and typically exhibits high output impedance and a large output voltage range. The biasing circuit 210 shown in FIG. 10(*b*), combines with the NMOS devices M1 and M2 of FIG. 8 to form a cascode current mirror, which has a high impedance but has a reduced output voltage range relative to the wide swing mirror 200. FIG. 10(*c*) shows a biasing circuit 220 that combines with M1 and M2 of FIG. 8 to form a current mirror with a low power consumption relative to current mirrors 200 and 210 shown in FIGS. 10(*a*) and 10(*b*). It should be understood, however, that many other biasing circuits could be used, and the present invention is not limited to use with the biasing circuits 200, 210 and 220 shown in FIGS. 10(*a*)–10(*c*). Rather, these exemplary biasing circuits 200, 210 and 220 are shown for illustrative purposes only.

Figure 11:
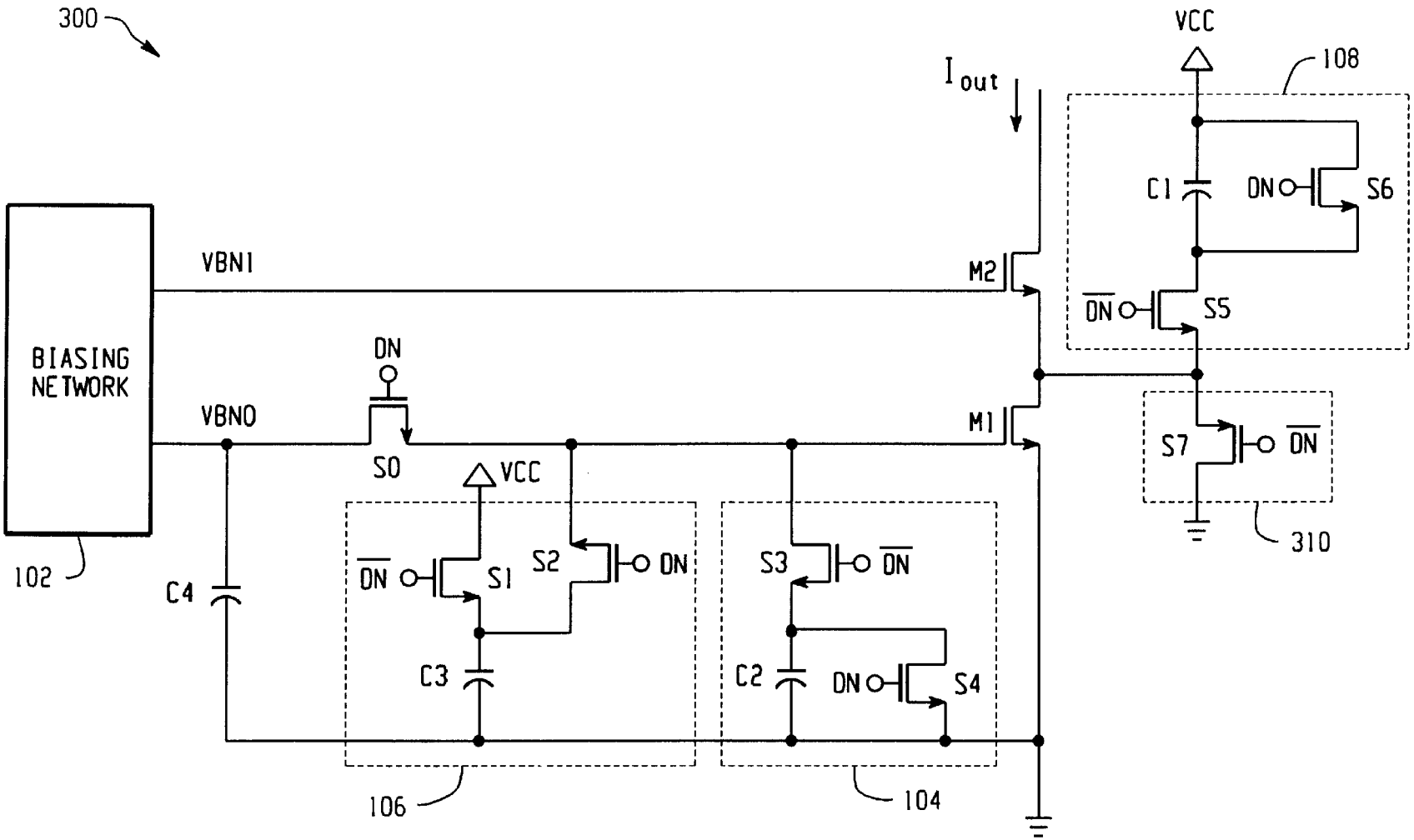
FIG. 11 is a circuit diagram of another embodiment of the exemplary boot-strapped current mirror switch shown in FIG. 8.

FIG. 11 is a circuit diagram of another embodiment of the exemplary boot-strapped current mirror shown in FIG. 8.

This circuit 300 is similar to the current mirror switch 100 shown in FIG. 8, with the addition of another boot-strapping circuit 310 coupled to the source terminal of M2 that further improves the turn-on speed of the current mirror 300. This additional boot-strapping circuit 310 includes a PMOS switch S7 coupled between the source terminal of M2 and ground. When DN transitions from low to high turning the circuit 300 ON, the PMOS switch S7 is opened, coupling the source of the NMOS device M2 to ground and quickly increasing the gate-source voltage of M2. Then, as M2 turns on and the gate-source voltage of the PMOS switch S7 falls below its threshold turn-on voltage, the PMOS switch S7 turns itself off. Preferably, the PMOS switch S7 is chosen such that the voltage needed at its source terminal in order to turn the PMOS switch S7 off is only slightly less than the source voltage at which M2 turns on. In this manner, the PMOS switch S7 provides a very fast current path to pull down the source of M2, and then quickly becomes benign once M2 is turned on.

Figure 12:
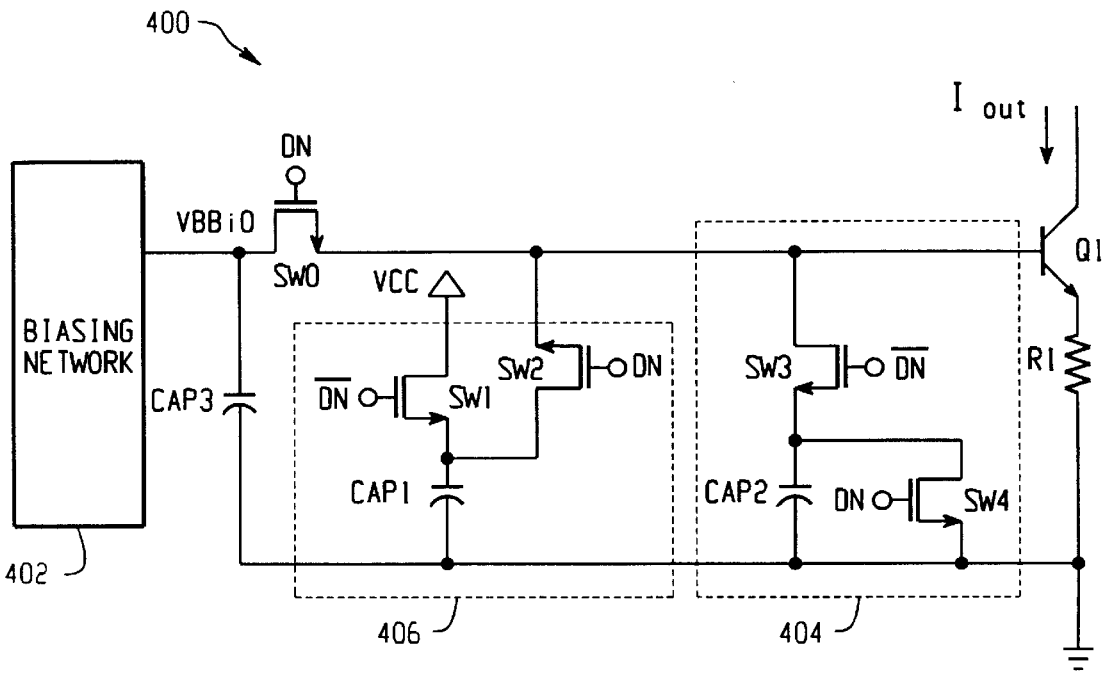
FIG. 12 is a circuit diagram of an exemplary boot-strapped current mirror utilizing a BiCMOS design that generates a negative output current (Iout)

FIG. 12 is a circuit diagram of an exemplary boot-strapped current mirror 400 utilizing a BiCMOS design that generates a negative output current (Iout). This circuit 400 includes a biasing network 402, a bipolar transistor Q1, a resistor R1, an NMOS control switch SW0, a filtering capacitor CAP3, and two boot-strapping circuits 404 and 406. One boot-strapping circuit 404 includes a capacitor CAP2 and two NMOS switches SW3 and SW4, and is coupled to the base terminal of the bipolar transistor Q1. The other boot-strapping circuit 406 includes a capacitor CAP1 and two NMOS switches SW1 and SW2, and is also coupled to the base terminal of Q1. Each of the five NMOS switches SW0–SW4 is coupled to either a true or inverted control signal, DN or $\overline{\text{DN}}$.

The biasing network 402, described below with reference to FIG. 13, generates a substantially constant voltage output VBBiO that is coupled to the base terminal of the bipolar transistor Q1 through the NMOS control switch SW0. The emitter terminal of the bipolar transistor Q1 is coupled to ground, preferably through the resistor R1. The collector terminal of Q1 may be coupled to a load to implement a single current mirror. Alternatively, the collector terminal of Q1 may be coupled to the output of a second current mirror to implement a current mirror pair, as described below with reference to FIG. 15. In addition, the filtering capacitor CAP3 is preferably coupled between the biasing network output VBBiO and ground to minimize noise in the current mirror output (Iout).

The boot-strapping circuits 404 and 406 operate similarly to the boot-strapping circuits 104 and 106 described above with reference to FIG. 8, to improve the turn-on and/or turn-off speed of the current mirror 400. In the boot-strapping circuit 404, the capacitor CAP2 is coupled between ground and the base terminal of Q1 through the NMOS switch SW3, and the NMOS switch SW4 is coupled in parallel with the capacitor CAP2. Similar to the boot-strapping circuit 104 in FIG. 8, this boot-strapping circuit 404 improves the turn-off speed of the circuit 400 by injecting a zero potential (ground) at CAP2 onto the base terminal of Q1 as the current mirror 400 is turned OFF, and improves the turn-on speed by reducing the voltage swing necessary to raise the base terminal of Q1 back to its threshold turn-on voltage. In the boot-strapping circuit 406, the capacitor CAP1 is coupled between the power supply voltage VCC and ground through the NMOS switch SW1, and is also coupled to the base terminal of Q1 through the NMOS switch SW2. Similar to the boot-strapping circuit 106 in FIG. 8, this boot-strapping circuit improves the turn-on speed of the current mirror 400 by injecting the power supply voltage VCC at CAP1 onto the base terminal of Q1 as the current mirror is turned ON.

In alternative embodiments, the current mirror 400 could be implemented with only one of the two boot-strapping circuits 404 or 406. For instance, the turn-on speed of the current mirror 400 could be improved by including only the boot-strapping circuit 404 or 406. Similarly, the turn-off speed of the current mirror 400 could be improved by including only the boot-strapping circuit 404.

Operationally, when the BiCMOS current mirror 400 is ON, the DN control signal is in a high state causing a constant voltage output VBBiO from the biasing network 402 to be applied to the base of the bipolar transistor Q1 through the NMOS control switch SW0, enabling the output current (Iout) to flow through Q1 and R1. In addition, while the transistor Q1 is on, the capacitor CAP2 is discharged through the NMOS switch SW4.

When the BiCMOS current mirror 400 is switched OFF, the high to low transition of DN causes the NMOS control switch SW0 to open and the NMOS switch SW3 to close, disconnecting the base of the transistor Q1 from the biasing network 402 and connecting it to the capacitor CAP2, which was discharged during the preceding ON state. The capacitor CAP2 then causes the gate voltage of the transistor Q1 to decrease in proportion to the ratio of the capacitance of C2 and the parasitic capacitance between the base and emitter of Q1. This sharp reduction in voltage at the base of the transistor Q1, quickly brings the base-emitter voltage below its threshold turn-off voltage, cutting off the output current (Iout).

While the BiCMOS current mirror 400 is OFF, the capacitor CAP1 is charged to the power supply voltage VCC through the NMOS switch SW1. Then, when the current mirror 400 is switched back ON, the NMOS switches SW0 and SW2 close, and the power supply voltage VCC at the capacitor CAP1 is injected onto the base of the transistor Q1 along with VBBiO. The voltage at the capacitor CAP1 quickly brings the base-emitter voltage of the transistor Q1 above its threshold turn-on voltage, increasing the base voltage proportionally to the ratio of the capacitance of CAP1 and the parasitic base-emitter capacitance of Q1. This turn-on speed is further improved by prudent selection of the capacitance value of CAP2, such that when CAP2 is coupled to the base of Q1 through SW3, the ratio of CAP2 to the parasitic capacitance at Q1 is such that the voltage at the base of Q1 falls to a value below the threshold of Q1, but not all the way to ground. In addition, further voltage is injected onto the base of the transistor Q1 by CAP3 which provides an in-rush charge to the base of Q1 when the NMOS control switch SW0 closes.

Similar to the boot-strapped current mirror 100 described above with reference to FIG. 8, the BiCMOS current mirror 400 may be implemented as the DN switch 25 and the negative current source 24 in the charge pump 20 of FIG. 2, or in any other application in which a current switch is utilized. In addition, although all of the switches SW0–SW4 are shown as NMOS devices, the current mirror 400 may alternatively be implemented with other known switch types or designs, such as those shown in FIGS. 6(*b*)–6(*d*).

Figure 13:
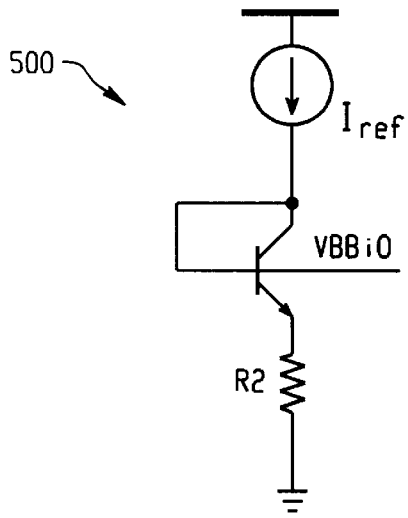
FIG. 13 is a circuit diagram of a typical biasing network that may be implemented as the biasing network in FIG. 12.

FIG. 13 is a circuit diagram of a typical biasing network 500 that may be implemented as the biasing network in FIG. 12. This biasing network 500 forms a current mirror with the transistor Q1 of FIG. 12, mirroring the reference current (Iref) as the output current (Iout) in FIG. 12. It should be understood, however, that this exemplary biasing network 500 is provided for illustrative purposes only, and is not intended to limit the many possible biasing networks that may be utilized in the current mirror 400 shown in FIG. 12.

Figure 14:
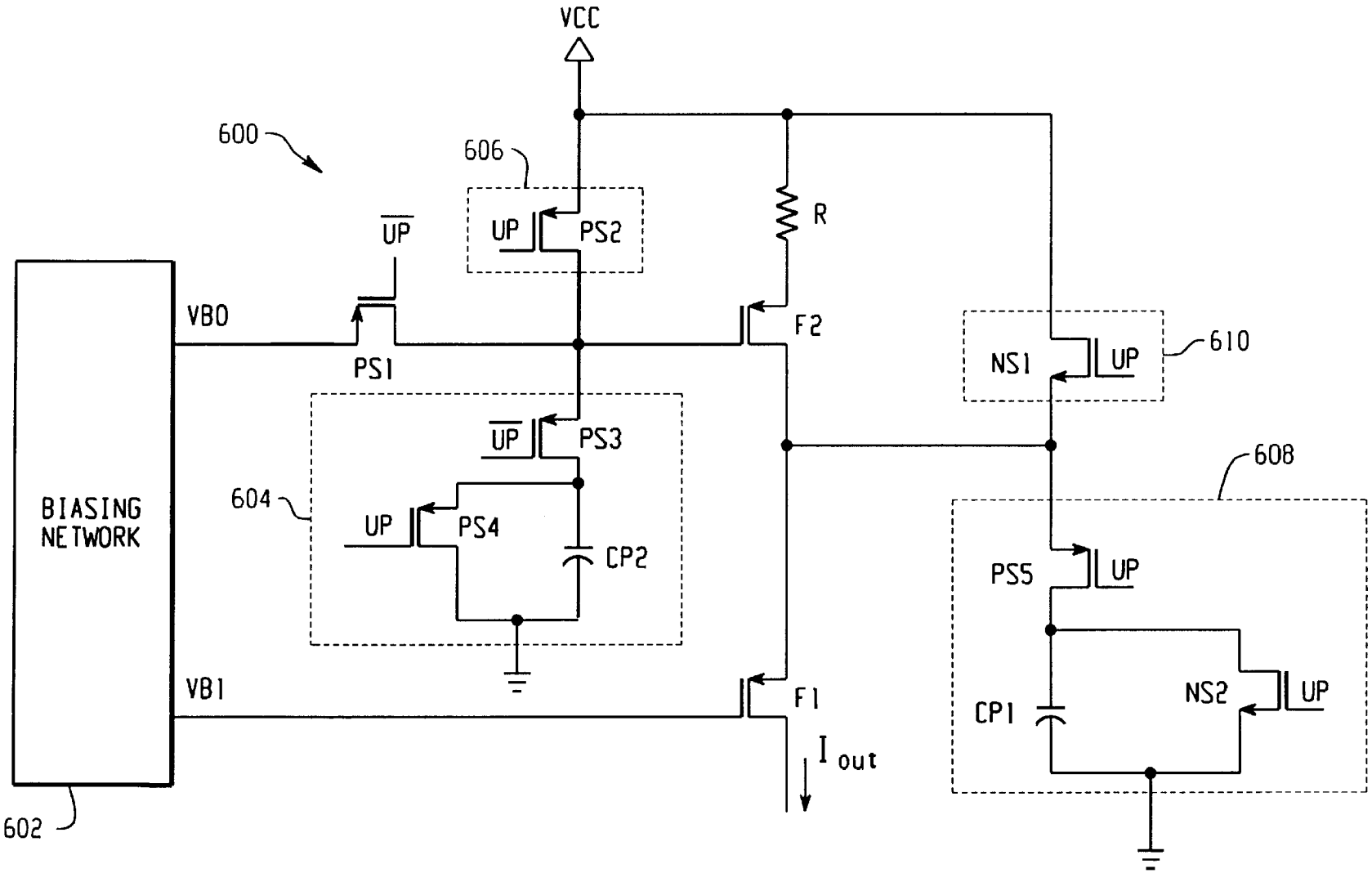
FIG. 14 is a circuit diagram illustrating an exemplary boot-strapped current mirror that generates a positive output current (Iout)

FIG. 14 is a circuit diagram illustrating an exemplary boot-strapped current mirror 600 that generates a positive output current (Iout). This circuit 600 includes a biasing network 602, two PMOS devices F1 and F2, a PMOS control switch PS1, a resistor R, and four boot-strapping circuits 604, 606, 608 and 610. One boot-strapping circuit 604 includes a capacitor CP2 and two PMOS switches PS3 and PS4, and is coupled to the gate terminal of the PMOS device F2. An additional boot-strapping circuit 606 includes a PMOS switch PS2, and is also coupled to the gate terminal of F2. Another boot-strapping circuit 608 includes a capacitor CP1, a PMOS switch PS5 and an NMOS switch NS2, and is coupled to the source terminal of the PMOS device F1. Yet another boot-strapping circuit 610 includes an NMOS switch 610, and is also coupled to the source terminal of F1. Each switch NS1, NS2 and PS1–PS5 is coupled to either a true or inverted control signal, UP or $\overline{UP}$. The UP control signal is preferably generated by an external circuit, and the inverted control signal, $\overline{UP}$, is preferably either similarly generated by an external circuit or by inverting UP.

The biasing network 602 generates two substantially constant voltage outputs, VB0 and VB1, which are below the threshold turn-on voltage of the PMOS devices F1 and F2. The biasing network 602 may, for example, consist of one of the known biasing circuits described above with reference to FIGS. 10(*a*)–10(*c*), in which the n-type FETs are replace with p-type FETs, power and ground are switched, and the current direction of the current source(s) is reversed. The biasing network output VB1 is coupled to the gate of the PMOS device F1, and the biasing network output VB0 is coupled to the gate of the PMOS device F0 through the control switch PS1. The drain terminal of the PMOS device F2 is coupled to the source terminal of the PMOS device F1, and the source terminal of F2 is coupled to the power supply voltage VCC through the resistor R. In an alternative embodiment, the resistor R may be omitted, with the source terminal of F2 coupled directly to the power supply voltage VCC. The drain terminal of the PMOS device F1 may be coupled to a load to implement the current mirror 600 as a single current mirror. Alternatively, the drain terminal of F1 may be coupled to the output of a second current mirror to implement a current mirror pair, as described below with reference to FIG. 15. Operationally, when the control signal UP is in a low state, the PMOS control switch S0 is closed and the PMOS devices F1 and F2 are ON, generating a positive current mirror output (Iout).

Similar to the negative current mirrors described above, the boot-strapping circuits 604, 606, 608 and 610 each improve either the turn-on or turn-off speeds of the current mirror 600 by injecting a potential onto critical nodes of the circuit 600. In the boot-strapping circuit 604, the capacitor CP2 is coupled between ground and the gate terminal of F2 through the PMOS switch PS3, and the PMOS switch PS4 is coupled in parallel with the capacitor CP2. This boot-strapping circuit 604 improves the turn-on speed of the circuit 600 by injecting a zero potential (ground) at CP2 onto the gate of the PMOS device F2 as the positive current mirror 600 is turned ON. The boot-strapping circuit 610 includes an NMOS switch 610 coupled between the source terminal of F1 and the power supply voltage VCC. The NMOS switch 610 further improves the turn-on speed of the current mirror 600 by injecting the power supply voltage VCC onto the source terminal of F1 as the circuit 600 is turned ON to quickly increase the source-gate voltage of F1. The boot-strapping circuit 606 includes a PMOS switch PS2 coupled between the gate terminal of F2 and the power supply voltage VCC, and improves the turn-off speed of the current mirror 600 by injecting the power supply voltage VCC onto the gate terminal of F2 as the circuit 600 is turned OFF. In an alternative embodiment, the PMOS switch PS2 could couple the gate terminal of F2 to a voltage lower than VCC using a circuit similar to the boot-strapping circuit 406 described above with reference to FIG. 12. In this alternative embodiment, the boot-strapping circuit 606 would also improve the turn-on speed of the current mirror 600 by reducing the required voltage swing necessary to reach the threshold turn-on voltage of F2. The boot-strapping circuit 608 includes a capacitor CP1 coupled between ground and the source terminal of F1 through the PMOS switch PS5, and the NMOS switch NS2 coupled in parallel with the capacitor CP1. This circuit 608 further improves the turn-off speed of the current mirror 600 by injecting a zero potential (ground) at CP1 onto the source terminal of F1 as the current mirror 600 is turned OFF, sharply reducing the source-gate voltage of F1.

Operationally, when the UP control signal is in a high state and the $\overline{UP}$ control signal is in a low state, the positive current mirror 600 is ON. During the ON state of the current mirror 600, the PMOS control switch is closed and the biasing network outputs VB0 and VB1 are respectively coupled to the gate terminals of the PMOS devices F2 and F1, causing a positive output current (Iout) to flow through F2 and F1. In addition, while the current mirror 600 is ON, the capacitor CP1 is discharged through the NMOS switch NS2.

To turn the positive current mirror OFF, the control signal UP is switched from high to low. The PMOS switch PS1 then opens to disconnect the gate terminal of F2 from the biasing network, and the PMOS switch PS2 closes to couple the gate of F2 to the power supply voltage VCC. This sharp voltage increase at the gate terminal of the PMOS device F2 quickly turns F2 off. In addition, the high to low transition of the control signal UP causes the PMOS switch PS5 to close, connecting the source terminal of F1 to the capacitor CP1, which was discharged during the preceding ON state of the circuit 600. The zero potential at the capacitor CP1 reduces the voltage at the source of F1 in proportion to the ratio of the parasitic capacitance of F1 and the capacitance of CP1. By injecting a zero potential onto the source terminal of the PMOS device F1, the source-gate voltage of F1 is quickly decreased, cutting off the output current (Iout).

While the positive current mirror 600 is OFF, the capacitor CP2 is discharged through the PMOS switch PS4. Then, when the current mirror 600 is switched ON, the PMOS switches PS1 and PS3 close and the zero potential (ground) at the capacitor CP2 is injected onto the gate of the PMOS device F2 along with VB0. The zero potential at the capacitor CP2 quickly brings the gate-source voltage of F2 above its turn-on threshold, decreasing the gate voltage proportionally to the ratio of the parasitic capacitance of F2 and the capacitance of CP2. In addition, as the current mirror 600 is switched ON, the NMOS switch NS1 closes, injecting the power supply voltage VCC onto the source terminal of the PMOS device F1. Similar to the PMOS switch S7, described above with reference to FIG. 11, the NMOS switch NS1 becomes benign as F1 and F2 turn on, and the gate-source voltage of the NMOS switch NS1 falls below its threshold turn-on voltage. The NMOS switch NS1 is thus preferably chosen such that the voltage needed at its source terminal in order to turn the switch NS1 off is only slightly less than the source voltage at which F1 turns on.

This positive current mirror 600 could be implemented, for example, as the UP switch 23 and the positive current source 22 in the charge pump 20 of FIG. 2, or in any other application where a current switch is utilized. The switches PS1–PS5, NS1 and NS2 may be implemented with other known switch types or designs, such as those shown in FIGS. 6(*b*)–6(*d*). In addition, the current mirror 600 could be implemented with less than all of the four boot-strapping circuits 604, 606, 608 and 610. For instance, the turn-on speed of the current mirror 100 could be improved by including only the boot-strapping circuit 604 or 610. Similarly, the turn-off speed of the current mirror 600 could be improved by including only the boot-strapping circuit 606 or 608.

Figure 15:
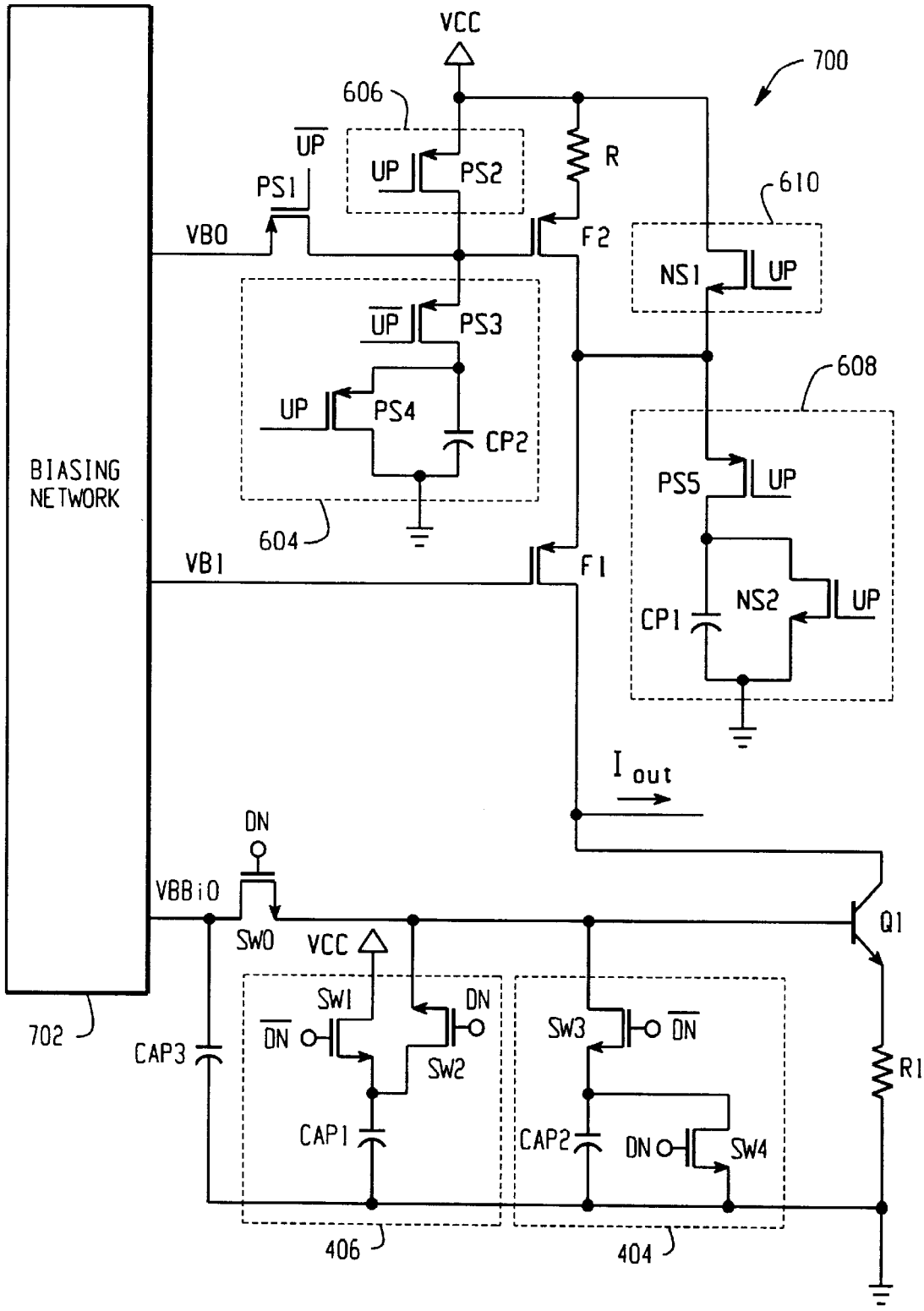
FIG. 15 is a circuit diagram illustrating an exemplary charge pump in which a positive current mirror is implemented with a PMOS current switch and a negative current mirror is implemented with a BiCMOS current switch.

FIG. 15 is circuit diagram illustrating an exemplary charge pump 700 in which a positive current mirror is implemented with a PMOS current switch and a negative current mirror is implemented with a BiCMOS current switch. The PMOS current switch is identical to the positive current mirror 600 described above with reference to FIG. 14, and includes the two PMOS devices F1 and F2, the PMOS control switch P0, the resistor R2, the filtering capacitor CP4, and the four boot-strapping circuits 604, 606, 608 and 610. Each switch P0–P6 and N1 in the PMOS current switch is coupled to either a true or inverted positive current signal, UP or $\overline{\text{UP}}$. The BiCMOS current switch is identical to the BiCMOS current mirror 400 described above with reference to FIG. 12, and includes the bipolar transistor Q1, the NMOS control switch SW0, the resistor R1, the filtering capacitor CAP3, and the two boot-strapping circuits 404 and 406. Each switch S0–S4 in the BiCMOS current switch is coupled to either a true or inverted negative current signal, DN or $\overline{\text{DN}}$.

The biasing network 702 preferably includes a positive-current biasing circuit for the PMOS current switch that generates two substantially constant voltage outputs VB0 and VB1, and a negative-current biasing circuit for the BiCMOS current switch that generates a substantially constant voltage output VBBiO. The positive-current biasing network output VB0 is coupled to the gate terminal of the PMOS device F2 through the PMOS control switch P0, and is also preferably coupled to the power supply voltage VCC through the filtering capacitor CP4. The positive-current biasing network output VB1 is coupled to the gate terminal of the PMOS device F1. The source terminal of F1 is coupled to the drain terminal of F2, and the source terminal of F2 is coupled to the power supply voltage VCC preferably through the resistor R2. The negative-current biasing network output VBBiO is coupled to the base terminal of the bipolar transistor Q1 through the NMOS control switch SW0, and is also preferably coupled to ground through the filtering capacitor CAP3. The emitter terminal of Q1 is coupled to ground preferably through the resistor R1. In addition, the drain terminal of the PMOS device F1 is coupled to the collector terminal of the bipolar transistor Q1 to produce the charge pump output (Iout). The boot-strapping circuits 404, 406, 604, 606, 608 and 610 are coupled to critical nodes of F1, F2 and Q1, and operate, as described above with reference to FIGS. 12 and 14, to improve the turn-on and/or turn-off time of the current switches.

Operationally, the positive current mirror operates as described above with reference to FIG. 14 to generate a positive output current (Iout) when the positive control signal UP is in a high state. The negative current mirror operates as described above with reference to FIG. 12 to generate a negative output current (Iout) when the negative control signal DN is in a high state.

Figure 16:
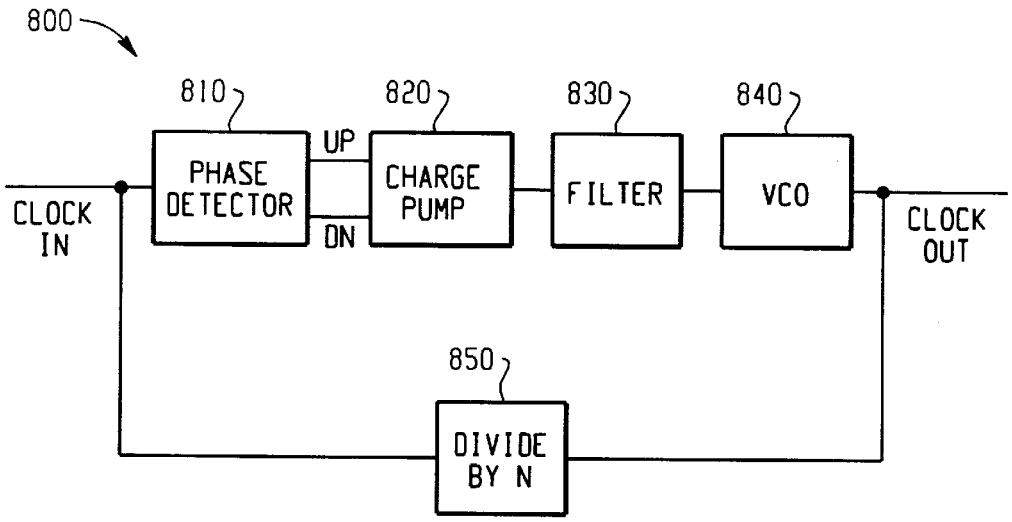
FIG. 16 is a block diagram of an exemplary phase-locked loop ("PLL") circuit in which a charge pump utilizing boot-strapped current mirrors may be implemented.

FIG. 16 is a block diagram of an exemplary phase-locked loop ("PLL") frequency synthesizer circuit 800 in which a charge pump 820 utilizing boot-strapped current mirrors may be implemented. The PLL circuit 800 includes a phase detector 810, the charge pump 820, a filter 830, a voltage controlled oscillator 840 and a divider 850. The charge pump 820 may, for example, be implemented using the exemplary charge pump 700 described above with reference to FIG. 15. It should be understood, however, that this PLL circuit 800 is just one example of many applications for the boot-strapped current mirrors discussed above with reference to FIGS. 8–15, including application in other known PLL designs.

Operationally, the phase detector 810 receives a reference signal (clock in) and also receives a feed-back signal from the divider 850, and compares the phases of the two signals to generate "UP" and "DN" control signals that are coupled to the charge pump 820. The charge pump 820 then generates an output current having a current direction that is controlled by the state of the "UP" and "DN" control signals. The output from the charge pump 820 is smoothed by the filter 830 and is coupled as an input to the voltage controlled oscillator 840, which controls the frequency of the PLL output signal (clock out). The frequency of the output signal (clock out) is divided by a predetermined value (N) in the divider 850 and coupled to the phase detector 810 as the feed-back signal. When the circuit 800 stabilizes (or locks) the frequency of the PLL output (clock out) is substantially equal to the frequency of the reference signal (clock in) multiplied by N, and the phases of the PLL output (clock out) and reference signal (clock in) are substantially synchronous.

Figure 17:
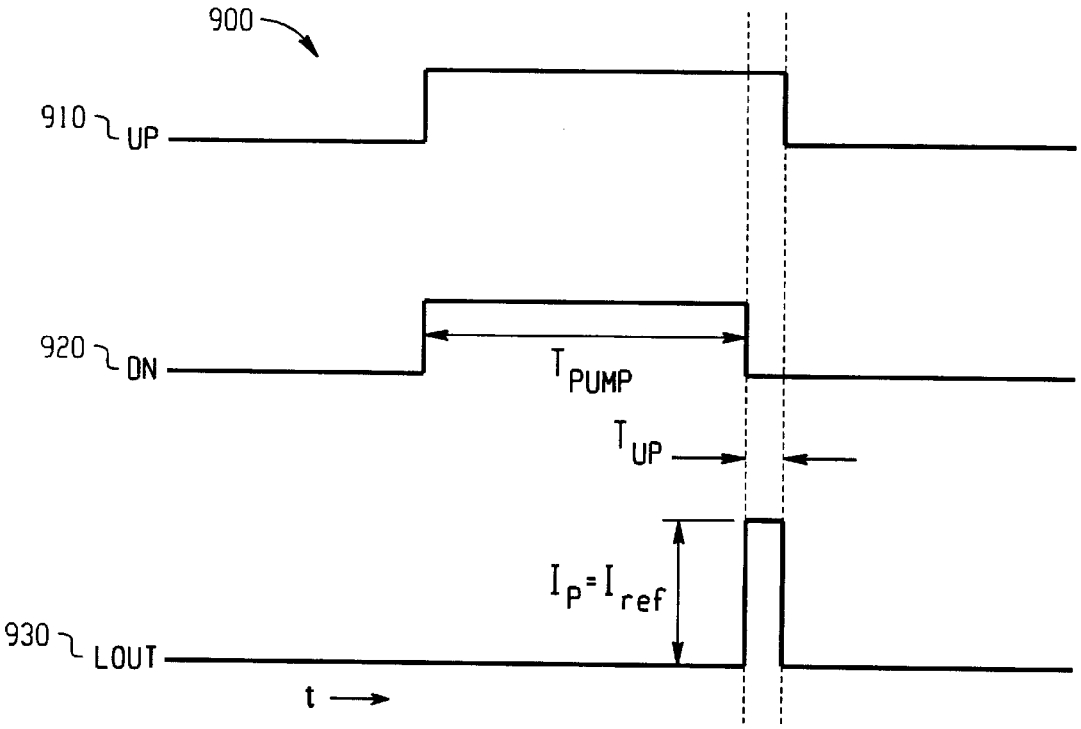
FIG. 17 is a timing diagram illustrating the operation of the charge pump shown in FIG. 16 when the output frequency of the PLL is less than desired.

FIG. 17 is a timing diagram 900 illustrating the operation of the charge pump 820 shown in FIG. 16 when the output frequency of the PLL 800 is less than desired. The diagram 900 illustrates one cycle of the UP 910 and DN 920 control signals and the corresponding output current (Iout) 930 from the charge pump. To increase the PLL output frequency, the phase detector 810 generates high pulses on the UP 910 and DN 920 control signals with the high pulse on the UP signal 910 being longer than the high pulse on the DN signal 920 by an amount (Tup) that is proportional to the desired increase in frequency. In response, the charge pump 820 generates a positive current pulse (Ip) on its output current 930 that is substantially equal to the difference (Tup) between the UP 910 and DN 920 control signal pulses. Then, as the PLL approximates the desired output frequency more closely, the difference (Tup) between the UP 910 and DN 920 pulses decreases until it becomes zero, and the PLL locks. When the PLL is locked, the UP 910 and DN 920 pulses should preferably switch simultaneously because any delay in either control pulse 910 or 920 will result in a glitch in the charge pump output (Iout) which is injected into the PLL output. Thus, the fast switching which may be achieved using a boot-strapped current mirror improves the performance of a PLL, particularly as the interval Tup progressively becomes narrower and locks at zero.

The embodiments described herein are examples of structures, systems or methods having elements corresponding to the elements of the invention recited in the claims. This written description may enable those skilled in the art to make and use embodiments having alternative elements that likewise correspond to the elements of the invention recited in the claims. The intended scope of the invention thus includes other structures, systems or methods that do not differ from the literal language of the claims, and further includes other structures, systems or methods with insubstantial differences from the literal language of the claims.

I claim:

1. A current mirror having an output current, comprising:

a biasing network that generates a substantially constant voltage on a first biasing network output;

a control signal having a first state and a second state;

a first transistor having a control terminal, a first current-carrying terminal, and a second current-carrying terminal, wherein the first current-carrying terminal generates the output current of the current mirror, and the second current-carrying terminal is coupled to a first potential;

a control switch coupled between the first biasing network output and the control terminal of the first transistor, and also coupled to the control signal, wherein the control switch couples the first biasing network output to the control terminal of the first transistor when the control signal is in the first state; and a first boot-strapping circuit coupled between the control terminal of the first transistor and a second potential, and also coupled to the control signal, wherein the first boot-strapping circuit injects the second potential onto the control terminal of the first transistor when the control signal transitions from the second state to the first state in order to decrease the turn-on time of the first transistor.

2. The current mirror of claim 1, wherein the control switch comprises a metal-oxide semiconductor field-effect transistor (MOSFET).

3. The current mirror of claim 1, wherein the control switch comprises an n-type metal-oxide semiconductor field-effect transistor (MOSFET) coupled in series with a p-type MOSFET.

4. The current mirror of claim 1, wherein the control switch comprises an n-type metal-oxide semiconductor field-effect transistor (MOSFET) coupled in parallel with a p-type MOSFET.

5. The current mirror of claim 1, wherein:

the first transistor is an n-type metal-oxide semiconductor field-effect transistor (MOSFET) having a gate terminal, a drain terminal and a source terminal, wherein the gate terminal corresponds to the control terminal, the drain terminal corresponds to the first current-carrying terminal and the source terminal corresponds to the second current-carrying terminal;

the first potential is ground; and the second potential is a power supply voltage (VCC).

6. The current mirror of claim 1, wherein the first transistor is an n-type bipolar transistor having a base terminal, a collector terminal and an emitter terminal, wherein the base terminal corresponds to the control terminal, the collector terminal corresponds the first current-carrying terminal and the emitter terminal corresponds to the second current-carrying terminal;

the first potential is a ground; and the second potential is a power supply voltage (VCC).

7. The current mirror of claim 1, wherein:

the first transistor is a p-type metal-oxide semiconductor field-effect transistor (MOSFET) having a gate terminal, a drain terminal and a source terminal, wherein the gate terminal corresponds to the control terminal, the drain terminal corresponds to the first current-carrying terminal and the source terminal corresponds to the second current-carrying terminal;

the first potential is a power supply voltage (VCC); and the second potential is ground.

8. The current mirror of claim 1, wherein the first boot-strapping circuit comprises:

a capacitor having a first terminal and a second terminal, wherein the first terminal is coupled to the first potential;

a first switch coupled between the second terminal of the capacitor and the second potential, and also coupled to the control signal, wherein the first switch couples the second terminal of the capacitor and the second potential when the control signal is in the second state; and a second switch coupled between the second terminal of the capacitor and the control terminal of the first transistor, and also coupled to the control signal, wherein the second switch couples the second terminal of the capacitor and the control terminal of the first transistor when the control signal is in the first state.

9. The current mirror of claim 8, wherein:

the first transistor is an n-type transistor;

the first potential is ground;

the second potential is a power supply voltage (VCC); and the first and the second switches both comprise an n-type metal-oxide semiconductor field-effect transistor (MOSFET).

10. The current mirror of claim 8, wherein the capacitor comprises an n-type metal-oxide semiconductor field-effect transistor (MOSFET) configured as an active capacitor.

11. The current mirror of claim 8, wherein the capacitor comprises a p-type metal-oxide semiconductor field-effect transistor (MOSFET) configured as a parasitic capacitor.

12. The current mirror of claim 1, wherein the first transistor is a p-type transistor, the first potential is a power supply voltage (VCC), the second potential is ground, and wherein the first boot-strapping circuit comprises:

a capacitor having a first terminal and a second terminal, wherein the first terminal is coupled to ground, a first switch coupled between the control terminal of the first transistor and the second terminal of the capacitor, and also coupled to the control signal, wherein the first switch couples the control terminal of the first transistor and the second terminal of the capacitor when the control signal is in the first state; and a second switch coupled in parallel with the capacitor, and also coupled to the control signal, wherein the second switch couples the first and second terminals of the capacitor when the control signal is in the second state.

13. The current mirror of claim 12, wherein the first and the second switches both comprise a p-type metal-oxide semiconductor field-effect transistor (MOSFET).

14. The current mirror of claim 12, wherein the capacitor comprises an n-type metal-oxide semiconductor field-effect transistor (MOSFET) configured as an active capacitor.

15. The current mirror of claim 12, wherein the capacitor comprises a p-type metal-oxide semiconductor field-effect transistor (MOSFET) configured as a parasitic capacitor.

16. The current mirror of claim 1, further comprising:

a filtering capacitor coupled between the first biasing network output and the first potential.

17. The current mirror of claim 1, further comprising a resistor coupled between the second current-carrying terminal of the first transistor and the first potential.

18. The current mirror of claim 1, further comprising a second boot-strapping circuit coupled between the control terminal of the first transistor and the first potential, and also coupled to the control signal, wherein the second boot-strapping circuit injects the first potential onto the control terminal of the first transistor when the control signal transitions from the first state to the second state in order to decrease the turn-off time of the first transistor.

19. The current mirror of claim 18, wherein the second boot-strapping circuit couples a capacitance between the control terminal of the first transistor and the first potential when the control signal is in the second state in order to decrease the turn-on time of the first transistor.

20. The current mirror of claim 18, wherein the second boot-strapping circuit comprises:

a capacitor having a first terminal and a second terminal, wherein the first terminal is coupled to the first potential;

a first switch coupled between the control terminal of the first transistor and the second terminal of the capacitor, and also coupled to the control signal, wherein the first switch couples the control terminal of the first transistor and the second terminal of the capacitor when the control signal is in the second state; and a second switch coupled in parallel with the capacitor, and also coupled to the control signal, wherein the second switch couples the first and second terminals of the capacitor when the control signal is in the first state.

21. The current mirror of claim 20, wherein:

the first transistor is an n-type transistor;

the first potential is ground;

the second potential is a power supply voltage (VCC); and the first and the second switches both comprise an n-type metal-oxide semiconductor field-effect transistor (MOSFET).

22. The current mirror of claim 20, wherein:

the first transistor is a p-type transistor;

the first potential is a power supply voltage (VCC);

the second potential is ground; and the first and the second switches both comprise a p-type metal-oxide semiconductor field-effect transistor (MOSFET).

23. The current mirror of claim 20, wherein the capacitor comprises an n-type metal-oxide semiconductor field-effect transistor (MOSFET) configured as an active capacitor.

24. The current mirror of claim 20, wherein the capacitor comprises a p-type metal-oxide semiconductor field-effect transistor (MOSFET) configured as a parasitic capacitor.

25. The current mirror of claim 1, wherein the first transistor is a p-type transistor, the first potential is a power supply voltage (VCC), the second potential is ground, and wherein the second boot-strapping circuit comprises a p-type metal-oxide semiconductor field-effect transistor (MOSFET).

26. The current mirror of claim 1, wherein the biasing network also generates a substantially constant voltage on a second biasing network output, and further comprising:

a second transistor having a first current-carrying terminal, a second current-carrying terminal coupled to the first current-carrying terminal of the first transistor, and a control terminal coupled to the second biasing network output, wherein the first current-carrying terminal of the second transistor generates the output current of the current mirror.

27. The current mirror of claim 26, wherein:

the second transistor is an n-type metal-oxide semiconductor field-effect transistor (MOSFET) having a gate terminal, a drain terminal and a source terminal, wherein the gate terminal corresponds to the control terminal, the drain terminal corresponds to the first current-carrying terminal and the source terminal corresponds to the second current-carrying terminal;

the first potential is ground; and the second potential is a power supply voltage (VCC).

28. The current mirror of claim 26, wherein:

the second transistor is a p-type metal-oxide semiconductor field-effect transistor (MOSFET) having a gate terminal, a drain terminal and a source terminal, wherein the gate terminal corresponds to the control terminal, the drain terminal corresponds to the first current-carrying terminal and the source terminal corresponds to the second current-carrying terminal;

the first potential is a power supply voltage (VCC); and the second potential is ground.

29. The current mirror of claim 26, further comprising a second boot-strapping circuit coupled between the second current-carrying terminal of the second transistor and the second potential, and also coupled to the control signal, wherein the second boot-strapping circuit injects the second potential onto the second current-carrying terminal of the second transistor when the control signal transitions from the first state to the second state in order to decrease the turn-off time of the second transistor.

30. The current mirror of claim 29, wherein the second boot-strapping circuit comprises:

a capacitor having a first terminal and a second terminal, wherein the first terminal is coupled to the second potential;

a first switch coupled between the second terminal of the capacitor and the second current-carrying terminal of the second transistor, and also coupled to the control signal, wherein the first switch couples the second terminal of the capacitor and the second current-carrying terminal of the second transistor when the control signal is in the second state; and a second switch coupled in parallel with the capacitor, and also coupled to the control signal, wherein the second switch couples the first and second terminals of the capacitor when the control signal is in the first state.

31. The current mirror of claim 30, wherein:

the first and the second transistors are n-type transistors;

the first potential is ground;

the second potential is a power supply voltage (VCC); and the first and the second switches are n-type metal-oxide semiconductor field-effect transistors (MOSFET).

32. The current mirror of claim 30, wherein:

the first and the second transistors is are p-type transistors;

the first potential is a power supply voltage (VCC);

the second potential is ground;

the first switch is a p-type metal-oxide semiconductor field-effect transistors (MOSFET); and the second switch is an n-type MOSFET.

33. The current mirror of claim 30, wherein the capacitor comprises an n-type metal-oxide semiconductor field-effect transistor (MOSFET) configured as an active capacitor.

34. The current mirror of claim 30, wherein the capacitor comprises a p-type metal-oxide semiconductor field-effect transistor (MOSFET) configured as a parasitic capacitor.

35. The current mirror of claim 26, further comprising:

a second boot-strapping circuit coupled between the second current-carrying terminal of the second transistor and the first potential, and also coupled to the control signal, wherein the second boot-strapping circuit injects the first potential onto the second current-carrying terminal of the second transistor when the control signal transitions from the second state to the first state in order to decrease the turn-on time of the second transistor.

36. The current mirror of claim 35, wherein the first and the second transistors are n-type transistors, the first potential is ground, and the second potential is a power supply voltage (VCC), and wherein the second boot-strapping circuit comprises:

a p-type metal-oxide semiconductor field-effect transistor (MOSFET).

37. The current mirror of claim 35, wherein the first and the second transistors are p-type transistors, the first potential is a power supply voltage (VCC), and the second potential is ground, and wherein the second boot-strapping circuit comprises:

an n-type metal-oxide semiconductor field-effect transistor (MOSFET).

38. The current mirror of claim 1, wherein the first transistor is an n-type transistor, the first potential is ground, and the second potential is a power supply voltage (VCC), and wherein the biasing network comprises:

a current source having a first terminal and a second terminal, wherein the first terminal of the current source is coupled to the second potential; and a biasing transistor having a control terminal, a first current-carrying terminal and a second current-carrying terminal, wherein the first current-carrying terminal of the biasing transistor is coupled to the second terminal of the current source and to the control terminal of the biasing transistor, and the second current-carrying terminal of the biasing transistor is coupled to the first potential, and wherein the control terminal of the biasing transistor generates the first biasing network output.

39. The current mirror of claim 38, further comprising:

a first resistor coupled between the second current-carrying terminal of the first transistor and the first potential; and a second resistor coupled between the second current-carrying terminal of the biasing transistor and the first potential;

wherein the first resistor has a substantially equal resistance value as the second resistor.

40. The current mirror of claim 38, wherein the first transistor and the biasing transistor comprise n-type bipolar transistors.

41. The current mirror of claim 26, wherein the biasing network comprises:

a current source having a first terminal and a second terminal, wherein the first terminal is coupled to the second potential;

a first biasing transistor having a control terminal, a first current-carrying terminal and a second current-carrying terminal, wherein the first current carrying terminal of the first biasing transistor is coupled to the second terminal of the current source, the control terminal of the first biasing transistor is coupled to the first current carrying terminal of the first biasing transistor, and wherein the control terminal of the first biasing transistor generates the second biasing network output;

a second biasing transistor having a control terminal, a first current-carrying terminal and a second current-carrying terminal, wherein the first current-carrying terminal of the second biasing transistor is coupled to the second current-carrying terminal of the first biasing transistor, the control terminal of the second biasing transistor is coupled to the first current-carrying terminal of the second biasing transistor, and the second current-carrying terminal of the second biasing transistor is coupled to the first potential, and wherein the control terminal of the second biasing transistor generates the first biasing network output.

42. The current mirror of claim 41, wherein:

the first and the second transistors are n-type transistors;

the first potential is ground;

and the second potential is a power supply voltage (VCC); and the first and the second transistors and the first and the second biasing transistors comprise n-type metal-oxide semiconductor field-effect transistors (MOSFETs).

43. The current mirror of claim 41, wherein:

the first and the second transistors are p-type transistors;

the first potential is a power supply voltage (VCC);

and the second potential is ground; and the first and the second transistors and the first and the second biasing transistors comprise p-type metal-oxide semiconductor field-effect transistors (MOSFETs).

44. The current mirror of claim 26, wherein the biasing network comprises:

a current source having a first terminal and a second terminal, wherein the first terminal is coupled to the second potential;

a first biasing transistor having a control terminal, a first current-carrying terminal and a second current-carrying terminal, wherein the control terminal of the first biasing transistor is coupled to the second terminal of the current source and generates the second biasing network output;

a second biasing transistor having a control terminal, a first current-carrying terminal and a second current-carrying terminal, wherein the first current-carrying terminal of the second biasing transistor is coupled to the second current-carrying terminal of the first biasing transistor, the second current-carrying terminal of the second biasing transistor is coupled to the first potential, and wherein the control terminal of the second biasing transistor generates the first biasing network output; and a resistor having a first and a second terminal, wherein the first terminal of the resistor is coupled to the second terminal of the current source and the second terminal of the resistor is coupled to the first current-carrying terminal of the first biasing transistor and the control terminal of the second biasing transistor.

45. The current mirror of claim 44, wherein:

the first and the second transistors are n-type transistors:

the first potential is ground;

the second potential is a power supply voltage (VCC); and the first and the second transistors and the first and the second biasing transistors comprise n-type metal-oxide semiconductor field-effect transistors (MOSFETs).

46. The current mirror of claim 44, wherein:

the first and the second transistors are p-type transistors:

the first potential is a power supply voltage (VCC);

the second potential is ground; and the first and the second transistors and the first and the second biasing transistors comprise p-type metal-oxide semiconductor field-effect transistors (MOSFETs).

47. The current mirror of claim 26, wherein the biasing network comprises:

a first current source having a first terminal and a second terminal, wherein the first terminal of the first current source is coupled to the second potential;

a first biasing transistor having a control terminal, a first current-carrying terminal and a second current-carrying terminal, wherein the first current-carrying terminal of the first biasing transistor is coupled to the second terminal of the first current source and the second current-carrying terminal of the first biasing transistor is coupled to the first potential;

a second current source having a first terminal and a second terminal, wherein the first terminal of the second current source is coupled to the second potential;

a second biasing transistor having a control terminal, a first current-carrying terminal and a second current-carrying terminal, wherein the first current-carrying terminal of the second biasing transistor is coupled to the second terminal of the second current source, and the control terminal of the second biasing transistor is coupled to the control terminal of the first biasing transistor, and wherein the control terminals of the first and second biasing transistors generate the second biasing network output; and a third biasing transistor having a control terminal, a first current-carrying terminal and a second current-carrying terminal, wherein the first current-carrying terminal of the third biasing transistor is coupled to the second current-carrying terminal of the second biasing transistor, and control terminal of the third biasing transistor is coupled to the first current-carrying terminal of the second biasing transistor, and the second current-carrying terminal of the third biasing transistor is coupled to the first potential, wherein the control terminal of the third biasing transistor generates the first biasing network output.

48. The current mirror of claim 47, wherein:

the first and the second transistors are n-type transistors:

the first potential is ground;

the second potential is a power supply voltage (VCC); and the first and the second transistors and the first, the second and the third biasing transistors comprise n-type metal-oxide semiconductor field-effect transistors (MOSFETs).

49. The current mirror of claim 47, wherein:

the first and the second transistors are p-type transistors:

the first potential is a power supply voltage (VCC);

the second potential is ground; and the first and the second transistors and the first, the second and the third biasing transistors comprise p-type metal-oxide semiconductor field-effect transistors (MOSFETs).

50. A current mirror having an output current, comprising:

a biasing network that generates a substantially constant voltage on a first biasing network output:

a control signal having a first state and a second state;

a first transistor having a control terminal, a first current-carrying terminal, and a second current-carrying terminal, wherein the first current-carrying terminal generates the output current of the current mirror, the second current-carrying terminal is coupled to a first potential;

a control switch coupled between the first biasing network output and the control terminal of the first transistor, and also coupled to the control signal, wherein the control switch couples the first biasing network output to the control terminal of the first transistor when the control signal is in the first state; and a boot-strapping circuit coupled between the control terminal of the first transistor and the first potential, and also coupled to the control signal, wherein the boot-strapping circuit injects the first potential onto the control terminal of the first transistor when the control signal transitions from the first state to the second state in order to decrease the turn-off time of the first transistor, and couples a capacitance between the control terminal of the first transistor and the first potential when the control signal is in the second state in order to decrease the turn-on time of the first transistor.

51. A current mirror having an output current, comprising:

a biasing network that generates a first substantially constant voltage on a first biasing network output and a second substantially constant voltage on a second biasing network output;

a control signal having a first state and a second state;

a first transistor having a control terminal, a first current-carrying terminal, and a second current-carrying terminal, wherein the second current-carrying terminal is coupled to a first potential;

a second transistor having a control terminal, a first current-carrying terminal, and a second current-carrying terminal, wherein the second current-carrying terminal of the second transistor is coupled to the first current-carrying terminal of the first transistor, and wherein the first current-carrying terminal of the second transistor generates the output current of the current mirror;

a control switch coupled between the first biasing network output and the control terminal of the first transistor, and also coupled to the control signal, wherein the control switch couples the first biasing network output to the control terminal of the first transistor when the control signal is in the first state; and a first boot-strapping circuit coupled between the second current-carrying terminal of the second transistor and the second potential, and also coupled to the control signal, wherein the first boot-strapping circuit injects the second potential onto the second current-carrying terminal of the second transistor when the control signal transitions from the first state to the second state in order to decrease the turn-off time of the second transistor.

52. A current mirror having an output current, comprising:

a biasing network that generates a first substantially constant voltage on a first biasing network output and a second substantially constant voltage on a second biasing network output;

a control signal having a first state and a second state;

a first transistor having a control terminal, a first current-carrying terminal, and a second current-carrying terminal, wherein the second current-carrying terminal is coupled to a first potential;

a second transistor having a control terminal, a first current-carrying terminal, and a second current-carrying terminal, wherein the second current-carrying terminal of the second transistor is coupled to the first current-carrying terminal of the first transistor, and wherein the first current-carrying terminal of the second transistor generates the output current of the current mirror;

a control switch coupled between the first biasing network output and the control terminal of the first transistor, and also coupled to the control signal, wherein the control switch couples the first biasing network output to the control terminal of the first transistor when the control signal is in the first state;

a first boot-strapping circuit coupled between the control terminal of the first transistor and a second potential, and also coupled to the control signal, wherein the first boot-strapping circuit injects the second potential onto the control terminal of the first transistor when the control signal transitions from the second state to the first state in order to decrease the turn-on time of the first transistor;

a second boot-strapping circuit coupled between the control terminal of the first transistor and the first potential, and also coupled to the control signal, wherein the second boot-strapping circuit injects the first potential onto the control terminal of the first transistor when the control signal transitions from the first state to the second state in order to decrease the turn-off time of the first transistor;

a third boot-strapping circuit coupled between the second current-carrying terminal of the second transistor and the second potential, and also coupled to the control signal, wherein the third boot-strapping circuit injects the second potential onto the second current-carrying terminal of the second transistor when the control signal transitions from the first state to the second state in order to decrease the turn-off time of the second transistor; and a fourth boot-strapping circuit coupled between the second current-carrying terminal of the second transistor and the first potential, and also coupled to the control signal, wherein the fourth boot-strapping circuit injects the first potential onto the second current-carrying terminal of the second transistor when the control signal transitions from the second state to the first state in order to decrease the turn-on time of the second transistor.

53. A method of increasing the speed of a current mirror, comprising the steps of:

providing a control signal having a first state and a second state;

providing a transistor that turns the current mirror on or off as the control signal transitions between the first state and the second state;

identifying a boot-strapped node on a terminal of the transistor; and injecting a boot-strapping potential onto the boot-strapped node of the transistor as the control signal transitions from the first state to the second state in order to decrease either the turn-on time or the turn-off time of the transistor.

* * * * *